US005898997A

United States Patent [19]

Meeker et al.

[11] Patent Number: 5,898,997

[45] Date of Patent: May 4, 1999

[54] METHOD FOR MANUFACTURING A WHEEL BEARING SPINDLE

[75] Inventors: Steven Eugene Meeker, Norwalk; Richard Allen Scheufler, Jr., Collins, both of Ohio

[73] Assignee: General Motors Corporation, Detroit, Mich.

[21] Appl. No.: 08/497,741

[22] Filed: Jul. 3, 1995

[51] Int. Cl.[6] ..... B21K 1/40

[52] U.S. Cl. ..... 29/894.362; 29/465; 301/6.7

[58] Field of Search ..... 29/465, 898.06, 29/894.36, 894.362, 894.361; 72/412, 464, 470, 476, 352, 360; 301/6.7, 6.8

[56] References Cited

U.S. PATENT DOCUMENTS

| | | | |
|---|---|---|---|
| 1,876,393 | 9/1932 | Booth | 29/894.362 |
| 4,179,167 | 12/1979 | Lura et al. | 308/189 A |
| 4,207,762 | 6/1980 | Kelly, Jr. | 72/360 |
| 4,227,396 | 10/1980 | Crowe | 72/476 |
| 4,316,374 | 2/1982 | Nagatsuma | 72/91 |
| 4,420,962 | 12/1983 | Peterson | 72/360 |
| 4,509,358 | 4/1985 | Krowl | 72/476 |
| 4,510,788 | 4/1985 | Ferguson et al. | 72/360 |
| 4,571,977 | 2/1986 | Ueno et al. | 72/352 |
| 4,748,708 | 6/1988 | Schlicht | 72/356 |
| 4,884,427 | 12/1989 | Sawahata et al. | 72/82 |
| 5,075,951 | 12/1991 | Schurr et al. | 29/428 |

*Primary Examiner*—Larry I. Schwartz
*Assistant Examiner*—Marc W. Butler
*Attorney, Agent, or Firm*—Patrick M. Griffin

[57] ABSTRACT

A wheel bearing spindle is produced by an improved method which provides adequate structural clearance from the sharp edge of a wheel drum hub, while actually improving the effective yield strength of the spindle. The spindle is produced from a near net shape steel forging which has a cylindrical spindle and flat wheel flange radiating therefrom. The circular hub of a brake drum fits radially closely over the pilot, and abuts with the wheel flange. Therefore, the juncture of the pilot and flange needs to be relieved or cut away somehow, both radially and axially, in order to assure non interference with the circular edge of the hub, which could prevent the rest of the hub from intimately abutting the surface of the wheel flange. The radial component of the clearance is provided by conventionally machining a channel radially into the pilot. This can be done, since it does not weaken the flange. The axial clearance, which has to be provided into the surface of the flange, is provided not by machining, but by a coining operation. This creates an axial channel of a specific shape which not only provides clearance but which, by strain hardening the surface of the flange near its juncture with the pilot, shifts the stress zone radially inwardly. This actually effectively increases the yield strength of the flange, despite the axial thinning of the flange.

2 Claims, 6 Drawing Sheets

METHOD FOR MANUFACTURING A WHEEL BEARING SPINDLE

This invention relates to methods of manufacturing wheel bearing spindles in general, and specifically to such a method that improves the yield strength of such a spindle at a critical structural juncture, without additional heat treating, while concurrently providing structural clearance from another component.

BACKGROUND OF THE INVENTION

Known wheel bearings of the type shown in FIGS. 1 and 2, and indicated generally at 10, have a stationary outer hub 12, which is secured to a non illustrated vehicle suspension, and a rotatable spindle, indicated generally at 14. Spindle 14 rotates because it carries the vehicle wheel 16, as well as a brake drum 18. Brake drum 18 is mounted to spindle 14 through an open, central circular hub 20, which has a predetermined axial thickness as measured between a pair of circular edges. The inner edge, indicated at 22, appears to be a sharp comer in cross section, and is generally referred to as the "theoretical sharp comer." Adequate clearance from the comer is important to the proper installation of the brake drum 18 to spindle 14. Specifically, spindle 14 includes a cylindrical pilot 24 with an outer surface over which the brake drum hub 20 is inserted, with a very close radial clearance. A flat annular wheel flange 26 radiates outwardly from the pilot 24, perpendicular thereto, with a flat outboard outer surface 28 against which the brake drum hub 20 is abutted, and an axially opposed inboard outer surface 30. The brake drum hub 20 is firmly sandwiched between the outboard abutment surface 28 and the wheel 16 itself, which is bolted onto conventional studs 32, when the vehicle is operating. In addition, small clips on the studs 32 can be used, if desired, to retain the brake drum hub 20 flat against the flange abutment surface 28 when the vehicle is stationary and the wheel 16 is removed. There is little need for such retainers, however, because of the close fit of hub 20 over the pilot 24, and such clips would be primarily needed during shipping, when the bearing 10 and brake drum 18 would be handled as a unit.

The primary concern relative to brake drum 18 is not shipping retention, but rather the maintaining of a close, flat to flat contact of the hub 20 against the wheel flange abutment surface 28 during vehicle operation. This assures the clean and efficient translation of braking loads on drum 18 to the spindle 14 and, ultimately, to wheel 16. To that end, a relief channel 34 is machined into both the outer surface of pilot 24 and the wheel flange abutment surface 28 at their circular, perpendicular juncture. Relief channel 34 is machined when the other critical surfaces, such as the pilot 24, are machined to final dimension on the initial blank from which spindle 14 is manufactured, which itself is forged to near net shape. Other structural features of spindle 14, such as the holes for the studs 32, are cut through the blank with dies. The existence of relief channel 34 at the point where the "theoretical sharp corner" represented by the edge 22 lies assures that, regardless of any tolerance variations in the edge 22, there will not be any physical interference that could potentially hold the surface of brake drum hub 20 away from the wheel flange abutment surface 28. However, the juncture between pilot 24 and the wheel flange 26 is critical for another reason. The stress of wheel loads on flange 26 tend to bend and flex it about its juncture with pilot 24, although the spindle flange 26 is made more than thick enough not to actually bend or crack significantly in actual operation. Nevertheless, if deliberately stressed to failure in a test fixture, such stresses will naturally concentrate in a predictable zone that finds the "weakest link", which is the effectively least thickness between the pilot 24-abutment surface 28 juncture and the opposed, inboard wheel flange surface 30. Such deliberately caused high stress will cause a crack to form through this stress zone, which is shown as a diagonal dotted line in FIG. 2, but represents, in fact, a conical surface. The necessary relief channel 34 does round out the otherwise sharp juncture between pilot 24 and flange 26, which tends to avoid stress concentration. More significantly, however, machining out the steel that creates the relief channel 34 significantly thins the flange 26 at the very point where stresses will concentrate, and thereby necessitates that flange 26 be thicker and heavier than it would otherwise have to be. Heat treating the surface of channel 34, as by induction methods, would harden it, but represents an additional and expensive step which is generally not done, in preference to just making flange 26 thick enough that the thinning created by the channel 34 is not a problem. While spindles like 14 do and have operated very successfully, it is a constant goal to improve designs and methods of manufacture so as to save weight and cost.

SUMMARY OF THE INVENTION

The invention provides a new method that produces the functional equivalent of the wheel bearing spindle described above, but in a more cost and weight effective manner.

The process starts with a similar near net shape forged steel blank, which has the same cylindrical pilot and flange as that described above. The necessary clearance from the edge of the brake drum hub is provided differently, however. The radial component of the necessary clearance is provided by machining a narrow radial channel into the outer surface of the blank pilot at the juncture of the pilot and wheel flange. The necessary axial clearance from the edge of the brake drum hub is created not by a machining operation that removes metal, but by a coining operation that uses two dies. A backing die basically conforms to and supports the inboard surface of the spindle wheel flange. A striking die has a central sleeve with a diameter just slightly greater than the blank pilot, and a flat surface radiating from the sleeve that generally conforms closely to the flat abutment surface of the blank's wheel flange. The one exception is an annular bead that surrounds the central sleeve concentrically. The bead has a curved radial cross section and protrudes above the striking die flat surface to a degree that increases gradually moving radially toward the sleeve, and then drops off steeply.

The spindle blank is supported on the backing die, and then hit with the striking die. The central sleeve passes freely over the pilot of the spindle blank, and its flat surface strikes the matching flat surface of the blank's wheel flange with little effect. Where the bead strikes, however, the surface of the flange's flat surface is displaced, leaving a matching axial relief channel that blends into the already machined radial relief channel. Most of the metal displaced by the bead's penetration is shifted elsewhere. Near the surface of the axial channel, however, a thin layer of the steel is strain or work hardened. The net effect of the process is twofold. First, the necessary axial clearance from the edge of the brake drum is achieved, without removing material from the flange. Second, the work hardening of the surface of the axial channel acts to shift the stress zone, that is, the point where a crack would begin if the flange were artificially stressed to failure, radially inwardly, and out of the axial channel. This, in turn, bridges the stress across an effectively thicker portion of the bead. The yield strength of the flange and spindle are thereby improved with no additional heat treating steps.

DESCRIPTION OF THE PREFERRED EMBODIMENT

These and other features of the invention will appear from the following written description, and from the drawings, in which.

Figure 1:
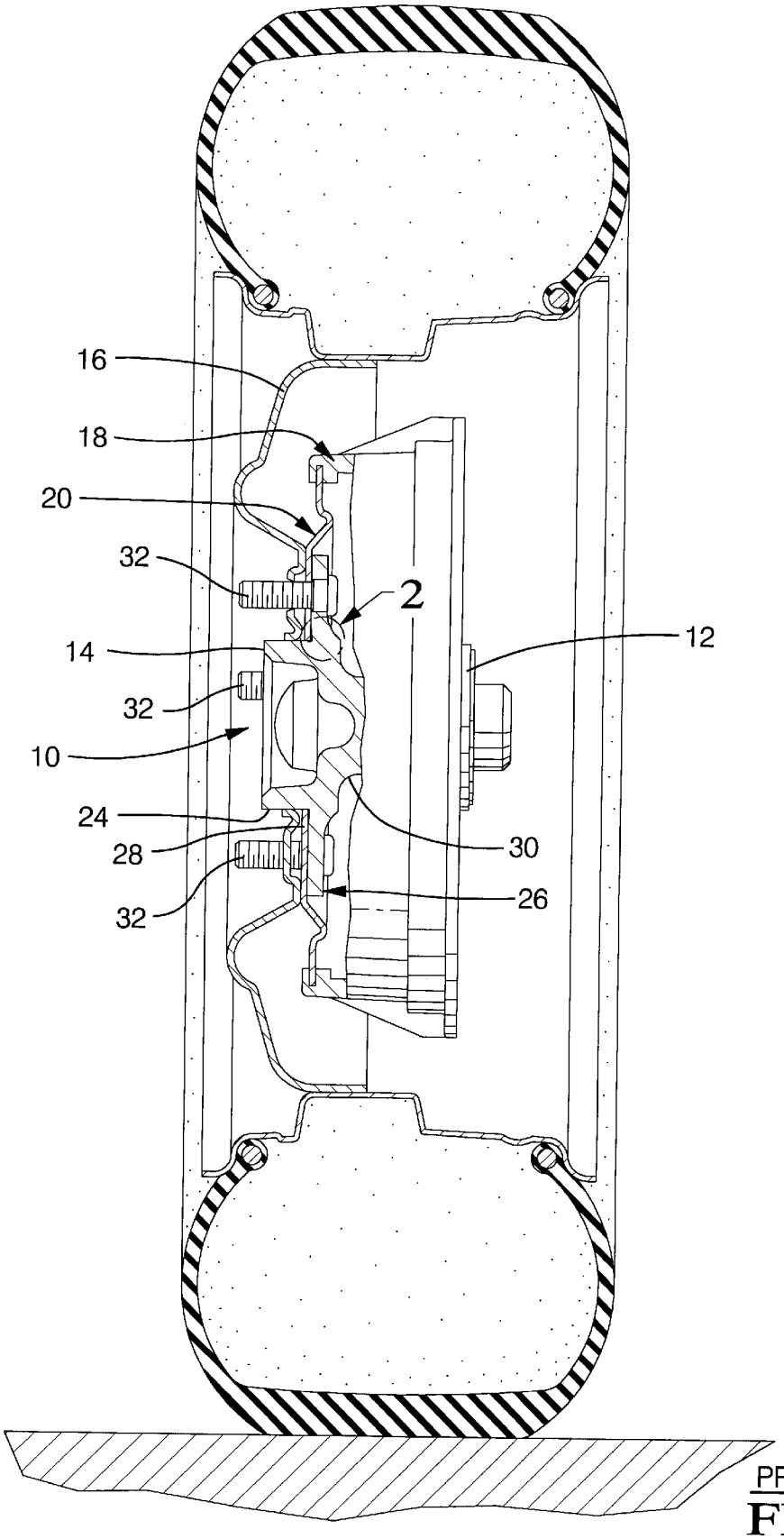
PRIOR ART FIG. 1
FIG. 1 is a view showing a prior art bearing and spindle partly in cross section, as well as a wheel and brake drum attached thereto.
Figure 2:
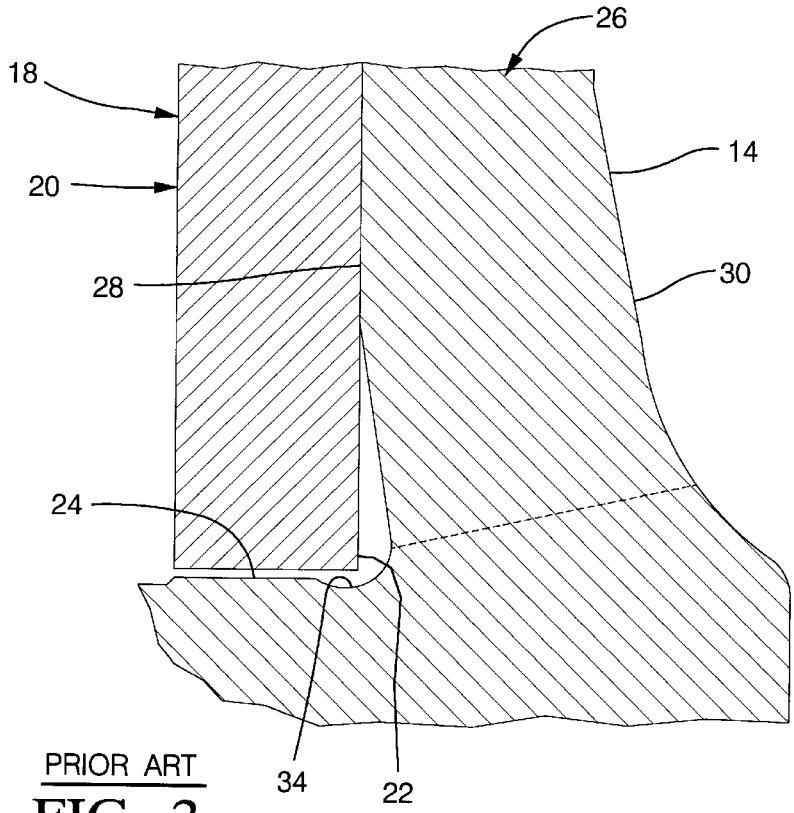
PRIOR ART FIG. 2
FIG. 2 is an enlargement of the circled portion of FIG. 1.
Figure 3:
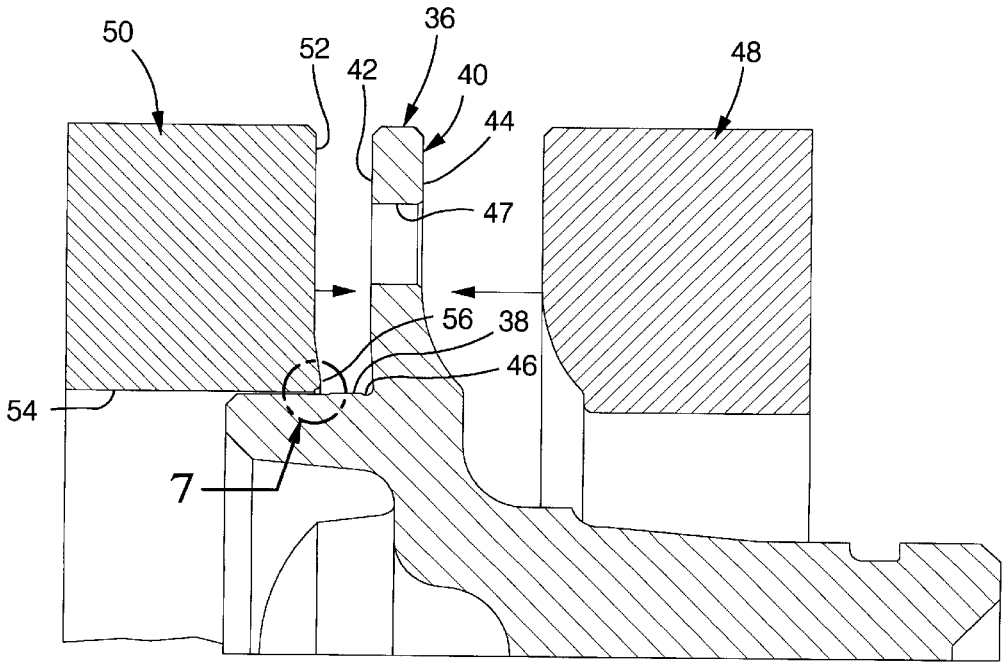
FIG. 3 is a view of the blank used to produce the spindle of the invention located between two dies.

Referring first to FIG. 3, a spindle made according to the process of the invention is used as part of the same kind of bearing 10 described above, and with the same wheel 16 and brake drum 18, and is therefore subject to the same loads and stresses. The process of the invention begins with a blank, indicated generally at 36, which is a steel forging that is very near to the shape that the finished spindle will have. Blank 36 has a cylindrical pilot 38 essentially identical to the spindle pilot 24 described above, and an outwardly radiating wheel flange 40 that is very similar to the prior art wheel flange 26, at least initially. It has a flat, outboard abutment surface 42, which ultimately will contact the brake drum hub 20, and an opposed inboard outer surface 44. The thickness of flange 40, as measured between the surfaces 42 and 44, is, at various areas, both thicker and thinner than wheel flange 26, as is described in greater detail below. As illustrated, the blank 36 has already had the surface of the pilot 38 and the abutment surface 42 machined to final dimension. The flat surface 42 need not be machined precisely flat all the way to it's juncture with pilot 38, however, because of a subsequent operation that significantly alters an annular area of surface 42 surrounding the juncture with pilot 38. In addition, as part of the same basic machining operation, a radial channel 46 is machined into the pilot 38 near it's juncture with the flange abutment surface 42, similar to the relief channel 34 described above. The radial channel 46 has an axial width less than the basic thickness of said brake drum hub 20, thereby providing radial clearance from only the near edge 22 of the brake drum hub 20, without jeopardizing the close radial fit of the rest of the pilot 38 to the brake drum hub. 20. Since the radial channel 46 is cut only into the pilot 38, it does not appreciably thin out or weaken the wheel flange 40. After the machining operation, the holes 47 for the wheel studs 32 may be pierced or otherwise formed. At that point, blank 36 has attained its basic shape, but for an additional operation to provide the necessary axial clearance from the edge 22, the tooling for and details of which are described below.

Figure 7:
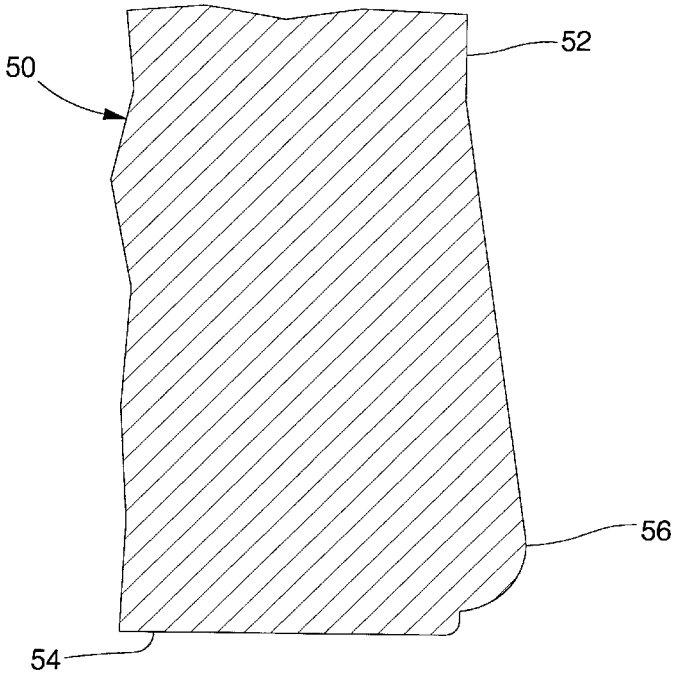
FIG. 7 is an enlarged view of the circled portion of the striking die in FIG. 3.

Referring next to FIGS. 3 and 7, the necessary axial edge clearance is created in a coining operation using two dies, a backing die 48, and a striking die, indicated generally at 50. Each die is a heavy annular ring, cut from a suitable die steel. Backing die 48 basically serves as a support, conforming to and backing up the wheel flange inboard surface 44, but does not act to significantly alter the shape of flange 40. Likewise, most of the contacting surface of striking die 50 is a flat surface 52 that also conforms to the abutment surface 42 of wheel flange 40, without altering it's shape. Similarly, striking die 50 has a cylindrical central sleeve 54 with a diameter that is very slightly larger than the diameter of the pilot 38, and so will pass freely over the pilot 38 without affecting it. The active portion of striking die 50 is a bead 56 that surrounds the sleeve 54 where it opens through the flat surface 52. Bead 56, as seen in radial cross section FIG. 7, has a shallow slope initially, ramping up from the plane of the flat surface 52 gradually until it changes direction rapidly near the central sleeve 54. Then, the bead 56 drops off sharply, but is still curved, not conical in cross section as a typical flat chamfer would be.

Figure 4:
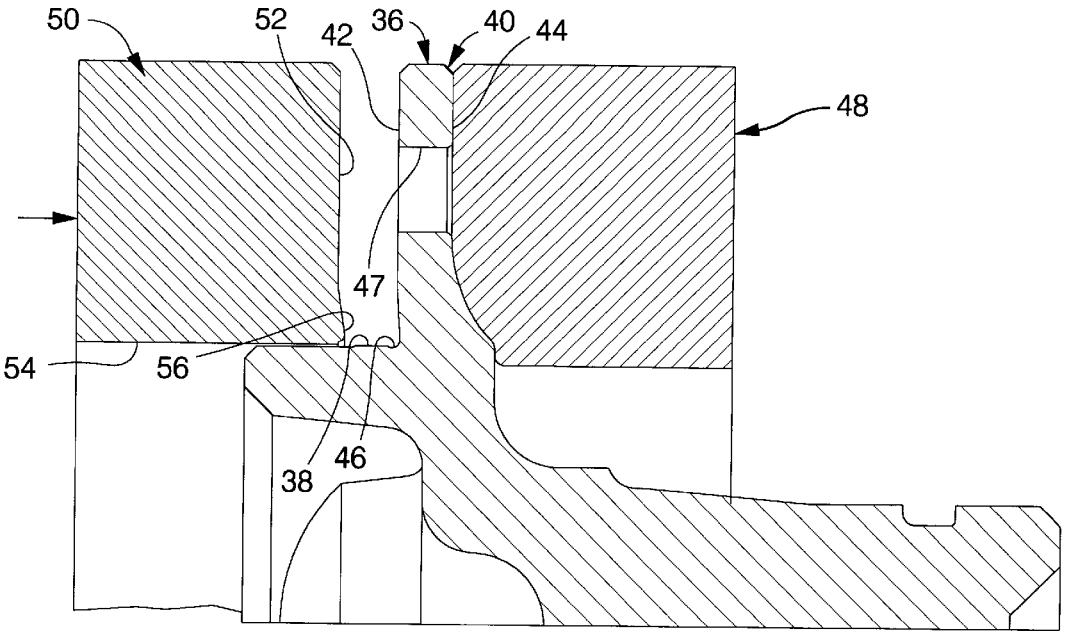
FIG. 4 is a view of the blank supported against one die before being struck by the other.

Referring next to FIG. 4, once the dies 48 and 50 have been cut to the shape described above, their operation is fairly straight forward. The blank 36 is supported on the backing die 48, and the striking die 50 is fixed to a non illustrated press that orients it precisely concentric to the pilot 38. Concentricity is critical because of the close clearance between the pilot 38 and the striking die central sleeve 54. Then, the striking die 50 is rammed forcefully into the outboard flange surface 42. For the embodiment disclosed, a press of approximately 100 tons force was used, although will obviously vary case to case. Concurrently, in reaction, the opposed surface 44 of the flange 40 is pushed forcefully into the backing die 48. The bead 56 contacts the flange outboard surface 42 very near the existing radial channel 46, leaving an axial relief channel 58 of matching shape that intersects the radial channel 46. At that point, the blank 36 has been basically finished to create a complete spindle, indicated generally at 60. Bead 56 does not remove metal, but rather displaces it, and, to a lesser extent, compresses it near the surface of the axial channel 58, which is described in more detail below.

Figure 5:
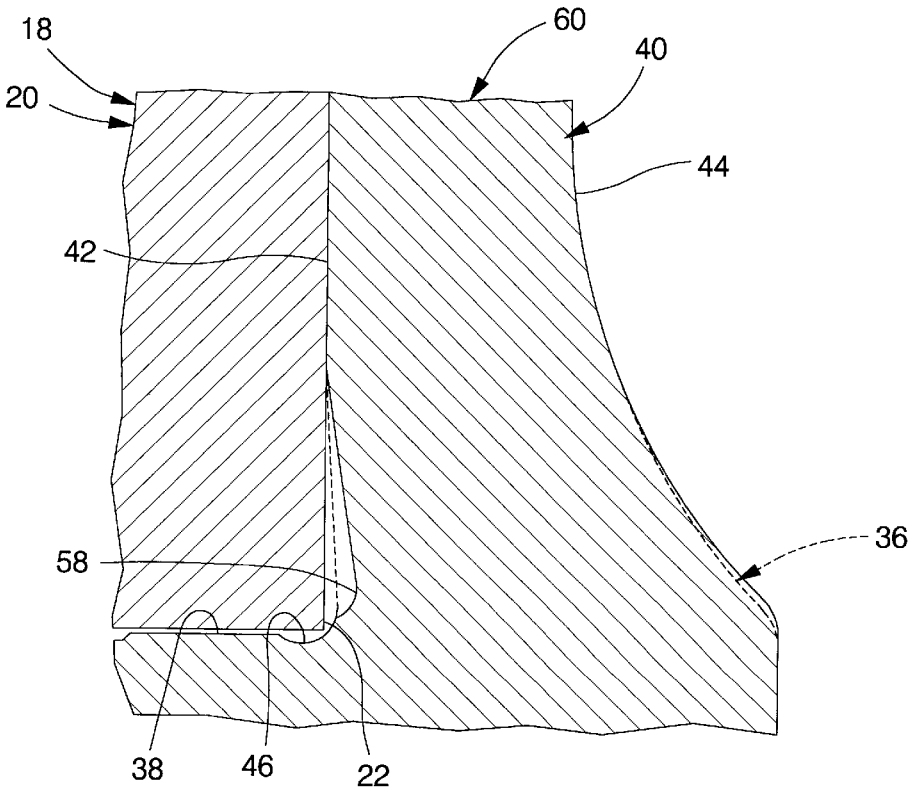
FIG. 5 is a view similar to FIG. 2, but showing the spindle of the invention, and also showing the profile of the blank in dotted lines.

Referring next to FIG. 5, the displacement process is best illustrated by showing the original profile of blank 36 in dotted line in those areas where it differs from the solid line profile of the completed spindle 60. Some metal is displaced to the opposed surface 44, especially in the area directly across from the axial channel 58, locally thickening the flange 40 somewhat, though not nearly to the degree that it is thinned by the creation of the axial channel 58. Still, metal is not removed as it would have been had axial channel 58 simply been machined, and must have a direction in which it can be displaced. Most of the displaced material is squeezed and displaced radially outwardly within flange 40. The shape of the bead 56, with its increase in height in a radially inward direction, aids in squeezing and displacing material radially outwardly. This allows for the use of less impact force in the press than would be the case than if the impacted and displaced material did not have as direct an escape route. The net result of the combined radial and axial channels 46 and 58, is that assured clearance from the brake drum hub edge 22, just as with the prior art relief channel 34 described above. However, the axial thinning caused by channel 58 does not, as would be expected, weaken flange 40, even though it does thin it out, for reasons described below.

Figure 6:
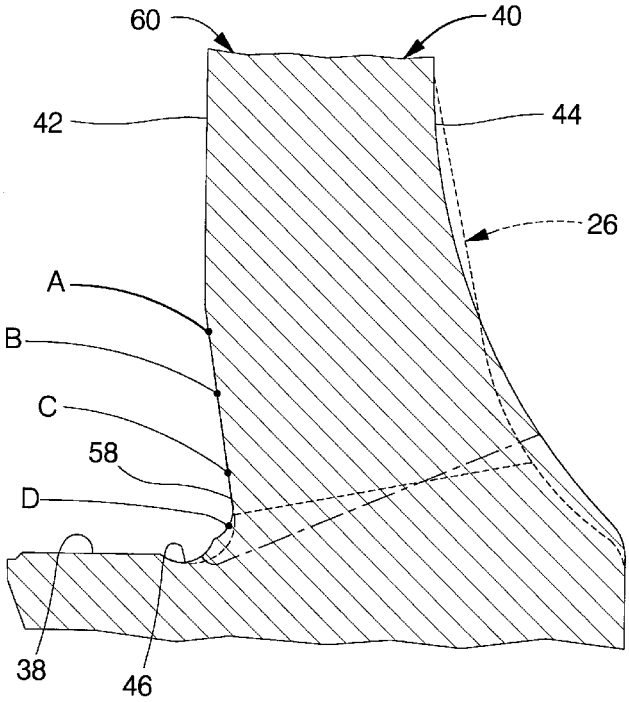
FIG. 6 is a cross section of the completed spindle taken and the juncture of the pilot and flange indicating various points at which the hardness is measured.

Referring next to FIG. 6, a more explicit comparison of the profiles of the prior art flange 26 (dotted line) and the flange 40 of the new spindle 60 is shown. The axial relief channel 58 is similar in cross sectional shape to the corresponding portion of the prior art relief channel 34, although the intersection point between the two channels 46 and 58 is convex, which is not structurally significant. Therefore, the equivalent clearance is created, both radially and axially, from the "theoretical sharp comer" of edge 22. As a consequence, secure, flat to flat contact between brake drum hub 20 and the wheel flange abutment surface 42 is assured. Compared to the prior art wheel flange 26, the wheel flange inboard surface 44 of spindle 60 presents an axial thickness that is both greater, in the area directly opposite to the axial channel 58, and thinner in the area that is further radially outboard. Some of the extra thickness, as alluded to above, is due to metal displaced by the coining operation from channel 58. Basically, however, the differing profile of the inboard surface 44 is the result of a concurrent design change that better apportions the axial thickness of wheel flange 40 toward the area where it is most critical, that is toward the stressed juncture of the flange 40 with pilot 38. As such, it is incidental to the process by which axial channel 58 is formed, although it does provide more mass backing up the area where the bead 56 strikes. Nevertheless, the coining process has a very beneficial structural effect on flange 40, beyond just providing axial clearance, and allows it to be thinner overall than it would be if the equivalent axial clearance had been simply machined in, for reasons described next.

Figure 8:
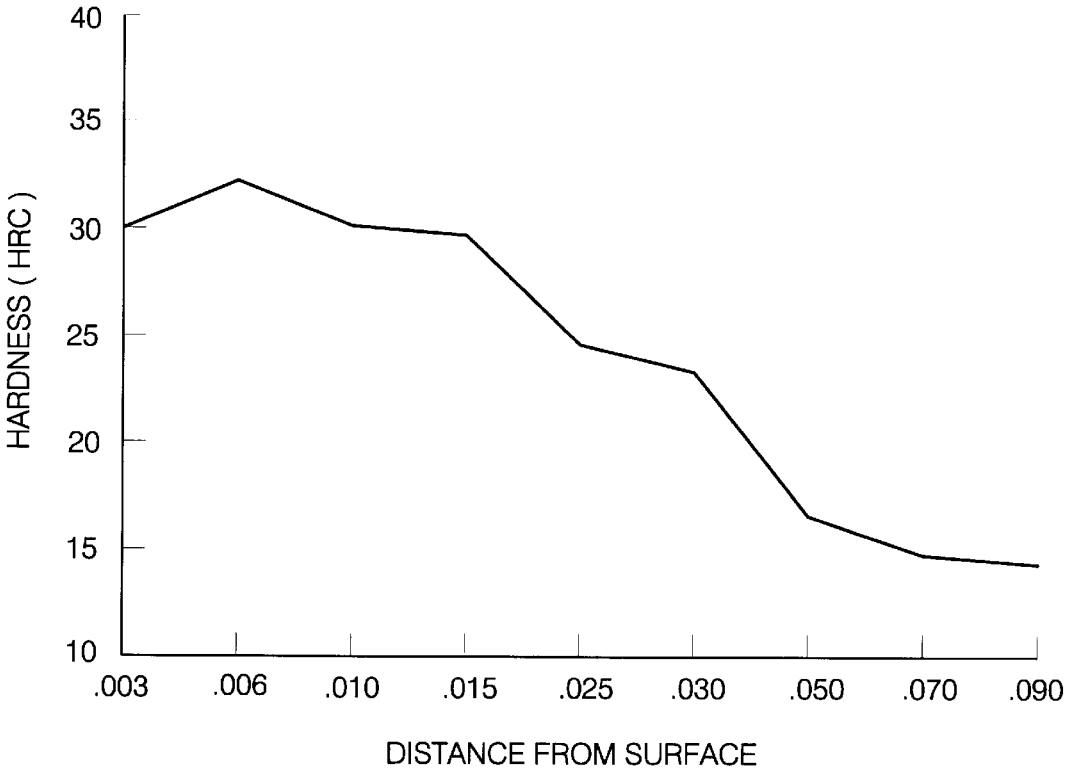
FIG. 8 is a graph showing the hardness at various increments into the surface taken near the point D in FIG. 6.
Figure 9:
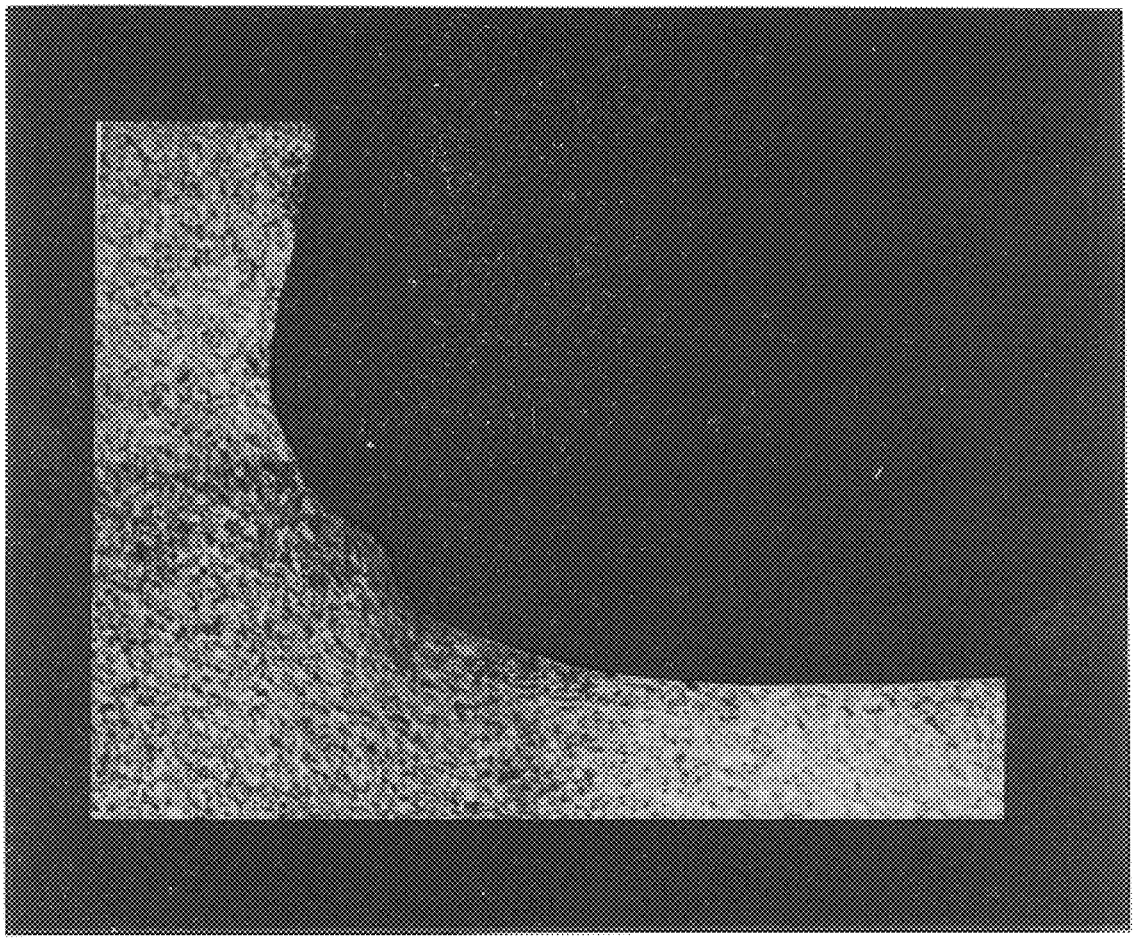
FIG. 9 is a photomicrograph enlargement of an actual section of a spindle taken at the juncture of the pilot and flange.

Referring next to FIGS. 6, 8 and 9, the effect of bead 56 extends beyond simply displacing metal as described above to create clearance. The physical effect of the impact of bead 56 on the grain structure of the metal is visible in FIG. 9, which is a photomicrograph of an actual spindle made according to the invention, sectioned and enlarged at the coined area. The impact strain or work hardens the surface of the axial channel 58, and does so to a degree that increases with the increase in thickness of the bead 56 itself. Thus, the surface hardness increases, moving radially inwardly toward the juncture with pilot 38, as indicated by hardness measurements made at the points A through D shown in FIG. 6, which were 21, 24, 28 and 31 respectively on the HRC scale. This progressive hardening is greatest nearest the juncture of the wheel flange 40 with the pilot 38, which is the natural "hinge point" or stress zone at which bending stresses on flange 40 would naturally concentrate. The hardening also occurs near the surface, as the graph in FIG. 8 shows, which indicates the hardness moving into the surface at various levels at the point D, the hardest point. Since the natural hinge point provided by the thinned axial channel 58 is hardened and made less flexible, and is, moreover, made hardest at it's most radially inward point, the stress zone is also shifted radially inwardly. If deliberately stressed to failure, a crack would initiate in spindle 60 at the location shown by the dot-dash line in FIG. 6, radially inward from and out of the axial channel 58. From the initiation site, the crack would migrate along the path of least resistance, that is, along the shortest route possible from the initiation site over to the opposed surface 44, which is shown in solid line in FIG. 6. By comparison, the location where the failure crack would form in a prior art spindle that was deliberately stressed to failure is shown by a dotted line, and it begins right in the axial channel 58 and bridges a thinner area of flange 40. Again, it should be understood that both spindles 14 and 60 are designed with a more than ample safety factor to prevent such cracking in anything but deliberate testing to failure, so the area where a crack could form is better termed a stress zone, and not a crack formation site. However, the shifting of the stress zone to a thicker area of the flange 40 does allow the flange 40 to be made axially thinner (and therefore lighter and less costly) than it would otherwise have to be, especially if the axial channel 58 were formed by conventional machining techniques. So, in conclusion, the axial channel 58 is formed by an inexpensive method which does not remove metal or strength from the flange 40, which hardens the channel 58 without an additional heat treating step, and which effectively increases the yield strength of flange 40.

Variations in the process disclosed could be made. It would accommodate any component, not just the central hub of a brake drum, in which edge clearance had to be provided in order to assure a solid intimate contact between two abutted flat surfaces. A different component might not have so close a radial edge clearance between it's equivalent to the hub edge 22 and the cylindrical pilot 38. In that case, formation of a separate radial clearance channel might not be needed, and the provision of an axial channel like 58 with sufficient radial width could provide all the clearance necessary to assure flat to flat contact. In such a case, only the coining operation would be needed. The machining and coining processes that provide the two channels 46 and 58 for spindle 60 are independent in the sense that they are carried out separately, but interactive in the sense that the processes are carried out so as to assure that the two physically intersect. This intersection, in turn, is assured by the close radial clearance between the striking die sleeve 54 and the spindle pilot 38. The exact cross sectional shape of the striking die bead disclosed could be altered somewhat. The bead must, of course, project above the plane of the striking die's flat surface 52 in order to displace metal at all, and it should have a curved, rather than a sharp, radial cross section, so as not to create a channel with stress risers. It's shape could, however, be more nearly semi circular, rather than the gradually upwardly sloping profile of the bead 56 disclosed, which is semi circular only where it drops off rapidly at the juncture with the sleeve 54. A strain hardened axial channel of more symmetrical curved cross section, near the juncture of the pilot 38 and the wheel flange flat face 42, would still shift the stress zone radially inwardly. However, the gradually sloping profile shown provides an axial channel 58 of greater radial width, for the equivalent amount of metal displaced. More important, it guides the displaced metal as noted above, and provides the maximal hardness at the optimal location.

We claim:

1. A method for manufacturing a metal wheel bearing spindle of the type having a cylindrical pilot with an outer surface over which a central circular hub of a brake component is closely radially fitted, said brake component hub having a predetermined axial thickness measured between two edges thereof, said spindle also having a flat annular wheel flange radiating from a juncture with said pilot with an outboard outer surface against which said brake component is abutted and an axially opposed inboard outer surface, and in which loads on said wheel spindle stress said wheel flange about a stress zone located near the juncture of said wheel flange and pilot, comprising the steps of, providing an intermediate spindle blank having dimensions substantially matching the completed wheel spindle, but for the juncture of said pilot and wheel flange, machining a narrow radial channel into the outer surface of said blank pilot at the juncture of said pilot and wheel flange, said radial channel having an axial width less than the axial thickness of said brake component, thereby providing radial clearance from one edge of said brake component central circular hub, providing a backing die that closely conforms to the inboard surface of said wheel flange, providing a striking die having a central sleeve with a diameter slightly larger than the diameter of said cylindrical pilot, a flat surface radiating from said central sleeve which matches said wheel flange outboard outer surface, and also having a generally annular bead with a curved radial cross section surrounding said central sleeve supporting said spindle blank in said backing die, orienting said striking die concentric to said cylindrical pilot, and, forcibly striking the outboard outer surface of said flange with said string die, thereby bringing said blank to final dimension and simultaneously producing an axial channel by displacing metal with said bead, said axial channel having a surface that is strain hardened near the juncture of said spindle pilot and wheel abutment flange, whereby, axial clearance from said one edge of said brake component central hub is provided by said axial channel, assuring intimate contact between the rest of said wheel flange outboard outer surface and said brake component, while the beginning point of said stress zone is shifted radially inwardly by said strain hardening so as to bridge an effectively thicker portion of said spindle wheel flange, thereby increasing the yield strength of said spindle.

2. A method for manufacturing a metal wheel bearing spindle of the type having a cylindrical pilot with an outer surface over which a central circular hub of a brake component is closely radially fitted, said brake component hub having a predetermined axial thickness measured between two edges thereof, said spindle also having a flat annular wheel flange radiating from a juncture with said pilot with an outboard outer surface against which said brake component is abutted and an axially opposed inboard outer surface, and in which loads on said wheel spindle stress said wheel flange about a stress zone located near the juncture of said wheel flange and pilot, comprising the steps of, providing an intermediate spindle blank having dimensions substantially matching the completed wheel spindle, but for the juncture of said pilot and wheel flange, machining a narrow radial channel into the outer surface of said blank pilot at the juncture of said pilot and wheel flange, said radial channel having an axial width less than the axial thickness of said brake component, thereby providing radial clearance from one edge of said brake component central circular hub, providing a backing die that closely conforms to the inboard surface of said flange, providing a striking die having a central sleeve with a diameter slightly larger than the diameter of said cylindrical pilot, a flat surface radiating from said central sleeve which matches said spindle wheel flange outboard outer surface, and also having a generally annular bead with a curved radial cross section surrounding said central sleeve, said bead protruding axially above the plane of said flat surface to a degree that increases gradually moving radially toward said central sleeve and then decreases rapidly near said central sleeve, supporting said spindle blank in said backing die, orienting said striking die concentric to said cylindrical pilot, and, forcibly striking the outboard outer surface of said flange with said striking die, thereby bringing said blank to final dimension and simultaneously producing an axial channel by displacing metal with said bead, said axial channel having a surface that is strain hardened to a degree that increases moving radially toward the juncture of said * and wheel abutment flange, whereby, axial clearance from the edge of said brake component central hub is provided by said axial channel, assuring intimate contact between the rest of said wheel flange outboard outer surface and said brake component, while the beginning point of said stress zone is shifted radially inwardly by said work hardening so as to bridge an effectively thicker portion of said spindle wheel flange, thereby increasing the yield strength of said spindle.

* * * * *